US006585249B1

(12) United States Patent
Andreyka et al.

(10) Patent No.: US 6,585,249 B1
(45) Date of Patent: Jul. 1, 2003

(54) LOW FRICTION ARTICLE FEEDING SYSTEM

(75) Inventors: James B Andreyka, Monroe, CT (US); Boris Rozenfeld, New Milford, CT (US); John W. Sussmeier, Cold Spring, NY (US); Jeffrey E. Vill, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 132 days.

(21) Appl. No.: 09/705,269

(22) Filed: Nov. 3, 2000

(51) Int. Cl.[7] ..... B65H 1/02
(52) U.S. Cl. ..... 271/2; 271/129; 271/149
(58) Field of Search ..... 271/2, 129, 149

(56) References Cited

U.S. PATENT DOCUMENTS 3,468,531 A * 9/1969 Whittington ..... 271/149
3,647,203 A * 3/1972 De Hart ..... 271/149
4,295,645 A * 10/1981 Nahar et al. ..... 271/146
4,884,795 A * 12/1989 Vander Syde ..... 271/146
5,413,323 A * 5/1995 Imbert et al. ..... 271/105

* cited by examiner

*Primary Examiner*—Christopher P. Ellis
*Assistant Examiner*—Mark A. Deuble
(74) *Attorney, Agent, or Firm*—Michael J. Cummings; Charles R. Malandra, Jr.; Angelo N. Chaclas

(57) ABSTRACT

A flat article hopper having a plurality of bottom rods to form a supporting surface for supporting a stack of flat articles and a paddle to push the flat articles towards a flat article feeder at the downstream end. A scrub wheel is rotatably mounted on a fixed, rotation axis on the paddle and is in contact with one of the bottom rods. The rotation axis of the scrub wheel is oriented at an angle relative to the rotation axis of the contacting rod, so that when the contacting rod rotates, it causes the scrub wheel to rotate, thereby producing a force on the paddle urging the paddle to move towards the downstream end. Preferably, the flat article hopper has a side rod on one side of the envelope stack, and the supporting surface is tilted from the horizontal surface, so that the flat articles are moved towards the side rod by gravity in order to register against the side rod. Preferably, the side rod also rotates in order to reduce the friction between the flat article stack and the side rod.

1 Claim, 5 Drawing Sheets

LOW FRICTION ARTICLE FEEDING SYSTEM

FIELD OF THE INVENTION

The present invention relates generally to a system for feeding substantially flat articles and, more specifically, to an article feeding system having a feeding surface with a low-coefficient friction surface.

BACKGROUND OF THE INVENTION

In a typical flat article feeding system, such as an envelope insertion machine for mass mailing, there is a gathering section where the enclosure material is gathered before it is inserted into an envelope. This gathering section includes a gathering transport with pusher fingers rigidly attached to a conveying means and a plurality of enclosure feeders mounted above the transport. If the enclosure material contains many documents, these documents are separately fed by different enclosure feeders. After all the released documents are gathered, they are put into a stack to be inserted into an envelope in an inserting station. At the same time, envelopes are sequentially fed to the inserting station, and each envelope is placed on a platform with its flap flipped back all the way, so that a plurality of mechanical fingers or a vacuum suction device can keep the envelope on the platform while the throat of the envelope is pulled away to open the envelope.

Before envelopes are fed to the insertion station, they are usually supplied in a stack in a supply tray or envelope hopper. Envelopes are then separated by an envelope feeder so that only one envelope is fed to the insertion station at a time. For that reason, an envelope feeder is also referred to as an envelope singulator. In a high-speed insertion machine, the feeder should be able to feed single envelopes at a rate of approximately 18,000 No. 10 envelopes per hour. At this feeding rate, it is critical that only a single envelope at a time is picked up and delivered to the insertion station.

At a feeding period approximately equal to 200 ms, there are roughly 30 ms available for the feeder to reset before the next feed cycle is initiated. If an envelope is not present in close proximity before the next feed time, acquisition of the next envelope will not occur and a feed cycle will be missed, resulting in a reduced machine throughput.

SUMMARY OF THE INVENTION

The first aspect of the present invention is a hopper for flat articles having an upstream end and a downstream end for providing a stack of flat articles to an article feeder located near the downstream end. The article hopper includes a first bottom rod having a first rotation axis substantially parallel to a moving direction, running from the upstream end to the downstream end. At least one second bottom rod is co-located on a plane with the first bottom rod in order to form a supporting surface to support the stack of flat articles. A paddle is provided behind the stack of flat articles and is pivotally mounted at a pivot located above the supporting surface, for urging the stack of flat articles to move along the moving direction towards the article feeder. And further provided is a scrub wheel, having a second rotation axis, rotatably mounted on the paddle and positioned to make contact with the first bottom rod, with the second rotation axis being oriented at an angle relative to the first rotation axis, wherein the first bottom rod is adapted to rotate along the first rotation axis, causing the scrub wheel to rotate along the second rotation axis in response to the rotation of the first bottom rod, thereby producing an urging force on the pushing device towards the downstream end.

Preferably, the second bottom rod also rotates in order to reduce the friction between the stack of flat articles and the supporting surface. The flat article hopper also preferably has a side rod parallel to the rotation axis and is located above the supporting surface for registering the stack of flat articles, and the side rod is adapted to rotate in order to reduce the friction between the stack of flat articles and the side rod. The supporting surface is preferably titled from the horizontal surface, urging the flat articles to move toward the side rod in order to register against the side rod. The pivot is preferably located above the supporting surface and on the opposite side of the side rod.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENTS

Figure 1:
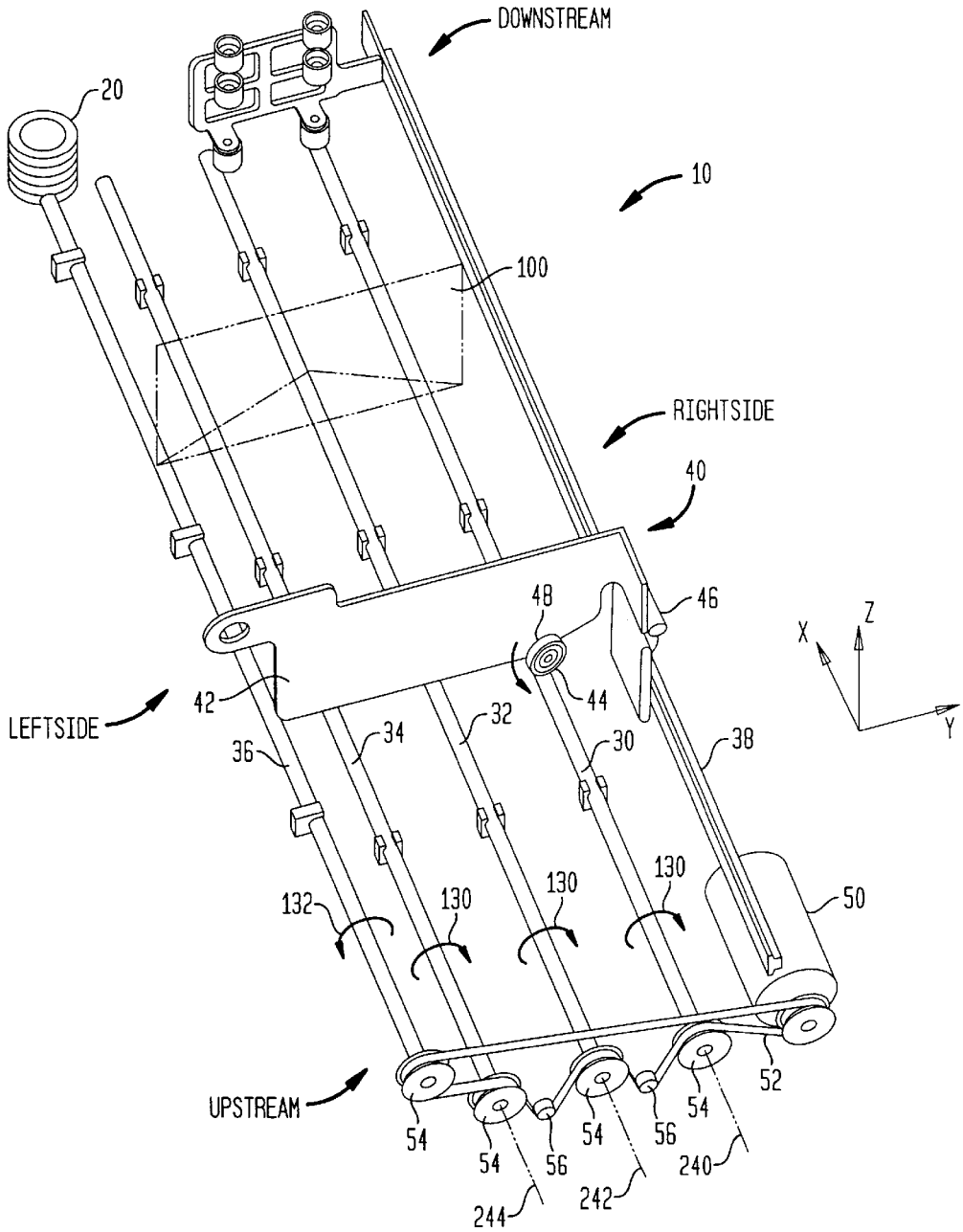
FIG. 1 is an isometric representation illustrating the flat article hopper of the present invention.

FIG. 1 illustrates a flat article hopper 10 in accordance with the teachings of the present invention. For ease of illustration and understanding, the flat article hopper of the present invention shall hereinbelow be described in terms of an envelope hopper for feeding envelopes. However, it is to be understood that the teachings of the present invention is not to be limited to an envelope hopper for feeding envelopes to an envelope feeding mechanism (as will be discussed below) but rather is to encompass any hopper for feeding flat articles to a suitable article feeding mechanism. For instance, such an example is an insert feeder, having an insert hopper, for feeding inserts to the chassis of an inserter system.

With reference now to the figures, as shown, the envelope hopper 10 includes a plurality of polished, bottom rods 30–34 for supporting a stack of envelopes 100 and providing the envelopes 100 to an envelope feeder 20 at the downstream end of the envelope hopper 10. As shown, the orientation of the envelope hopper 10 can be described in reference to a set of mutually orthogonal axes X, Y and Z. The rods 30–34 form a supporting surface 112 (see FIG. 2), which is parallel to the XY plane. The bottom rods 30–34 are substantially parallel to the X axis. Preferably, the envelope hopper 10 is tilted to the left such that the XY plane is rotated by angle β from a horizontal surface defined by the horizontal axis H. With such tilting, the envelopes 100 will have a tendency to move to the left side of the supporting surface 112 by gravity. A polished, side rod 36, which is also substantially parallel to X axis, is provided above the supporting surface 112 on the left-side of the envelope hopper 10 to register the left edge 102 of the envelopes 100, while the envelopes 100 are moved towards the envelope feeder 20 from upstream to downstream by an envelope pusher assembly 40. As shown in FIG. 1, the envelope pusher assembly 40 includes a stack advance paddle 42 pivotally mounted at pivot 46. The envelope pusher assembly 40 also has a rotatable scrub wheel 44 mounted on the stack advance paddle 42 at a fixed location. The scrub wheel 44 is positioned at an angle α with respect to the stack advance paddle 42 and rests on top of the rod 30 (see FIG. 3). The rods 3034 are driven by a motor 50 via a belt 52 and a plurality of rollers 54, 56 to rotate along a rotating direction 130 along rotation axes 240–244, respectively. Preferably, the rim 48 of the scrub wheel 44 has a frictional surface so that when the bottom rod 30 rotates along the rotation direction 130, it exerts a steering force on the stack advance paddle 42 towards the downstream direction through the scrub wheel 44. The envelope pusher assembly 40 is slidably mounted on a track 38, which is also parallel to the X axis, so that it can be urged by the scrub wheel 44 to move from upstream towards downstream. Preferably, the side rod 36 is also driven by the motor 50 to rotate along a direction 132 opposite to the rotation direction 130 in order to aid the envelopes 100 to register against the side rod 36 and to reduce the friction between the envelopes 100 and the rod 36.

Figure 2:
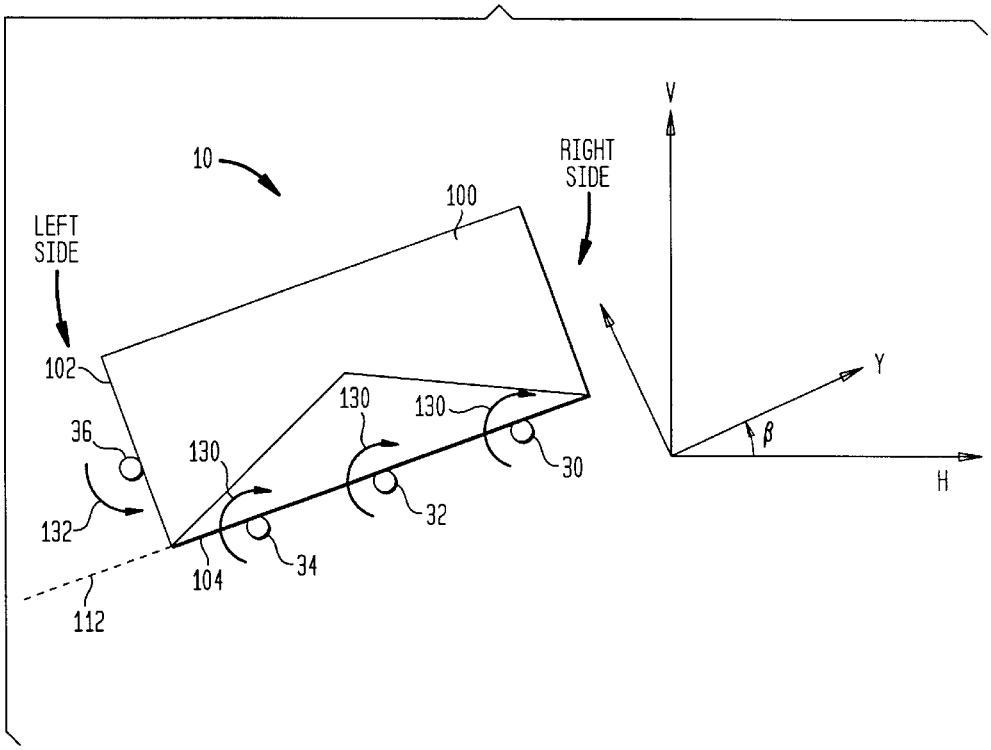
FIG. 2 is a diagrammatic representation illustrating the tilting of the supporting surface from a horizontal surface.
Figure 3:
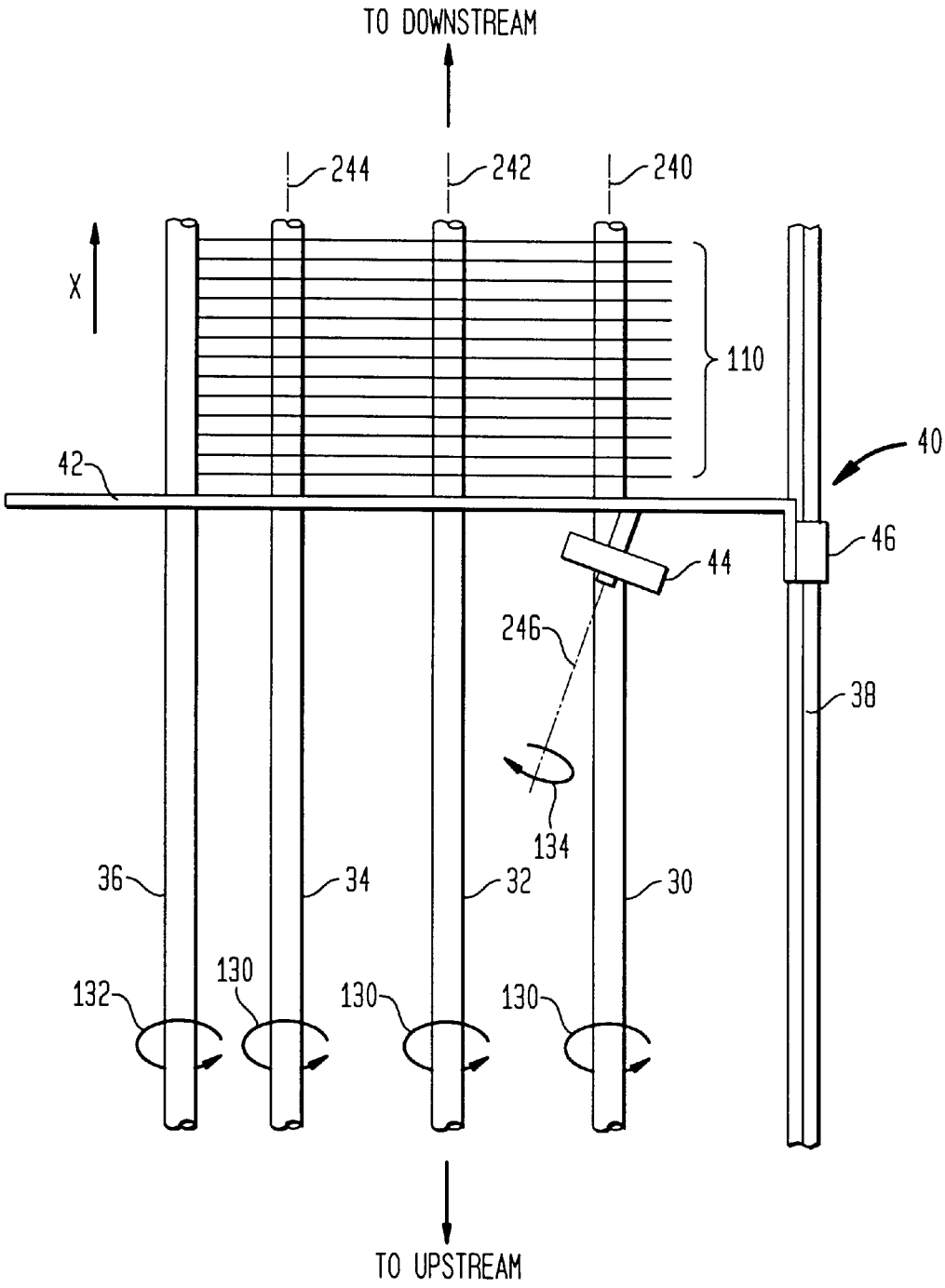
FIG. 3 is a diagrammatic representation illustrating the rotation axis of the scrub wheel in relation to the rotation axis of the bottom rods.

As shown in FIG. 2, the top edge 104 of the envelope 100 can be support by two of the bottom rods 30–32. The left edge 102 of the envelope 100 has a tendency to move toward and rest on the side rod 36. As shown in FIG. 3, the scrub wheel 44 is caused to rotate along a rotation direction 134, along a rotation axis 246, when the bottom rod 30 rotates along the rotation direction 130. Also shown in FIG. 3 is a stack 110 of envelopes 100 being pushed in the X direction towards downstream.

The arrangement of the scrub wheel 44 and the stack advance paddle 42 in relation to the rotation axis of the bottom rod 30 provides a rapid advance motion in the X direction for the stack advance paddle 42, when there is little or no force acting on the stack advance paddle 42 by the envelopes 100. In practice, the rapid advance motion only occurs when the hopper is refilled with envelopes and a gap (not shown) is produced between the envelope stack 110 and the stack advance paddle 42. As the paddle advances in the X direction and makes contact with the envelope stack 110, the paddle 42 encounters resistant forces in the stack 110. As the stack 110 compresses, the paddle velocity decreases.

Figure 4:
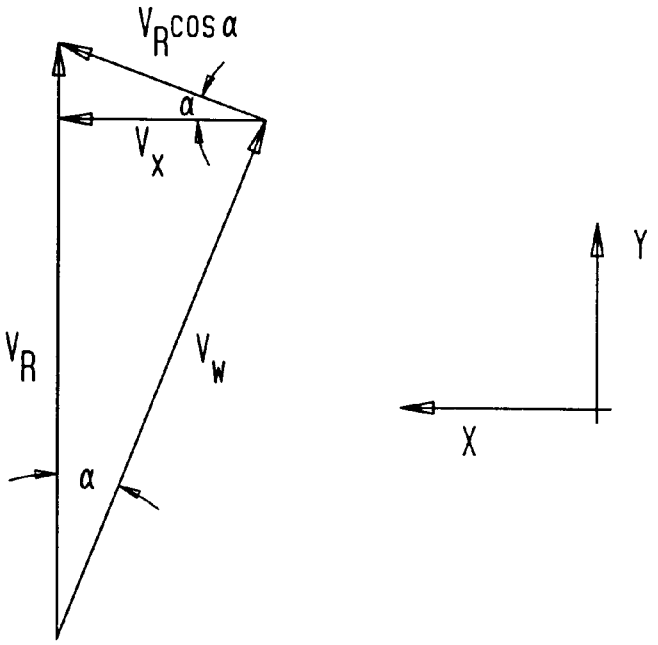
FIG. 4 is a vector diagram showing the relation between the velocity vector of the wheel and the velocity vector the bottom rod.
Figure 5:
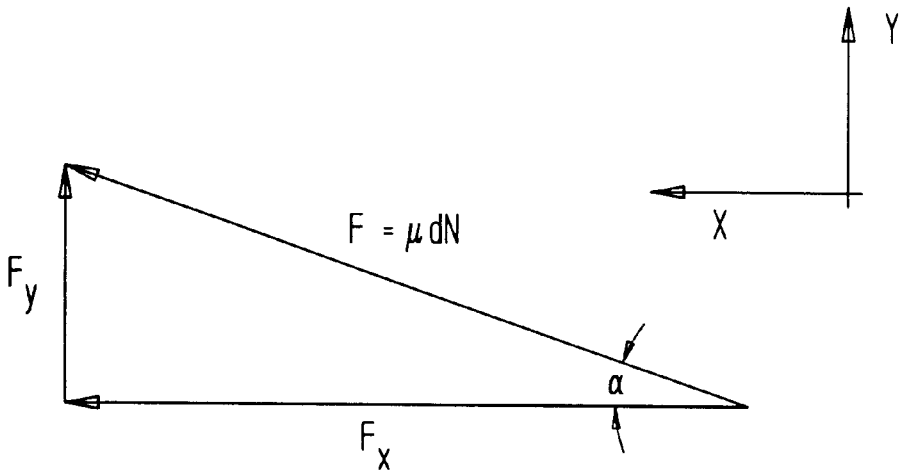
FIG. 5 is a vector diagram showing the relation between the total normal force between the wheel and the bottom rod and the force in the paddle advance direction.
Figure 6:
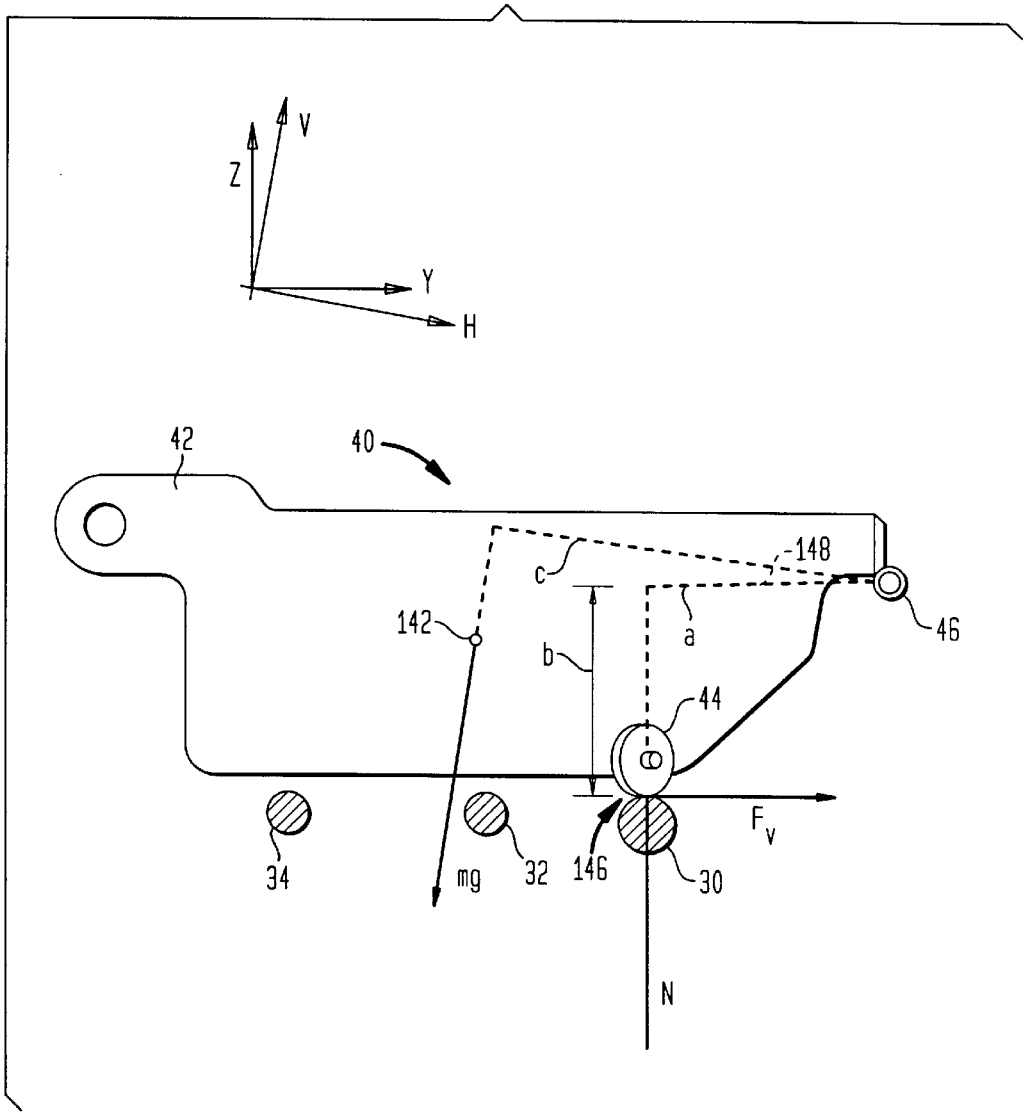
FIG. 6 is a diagrammatic representation showing moments about the pivot of the paddle arising from varies forces.

The forces and velocities are related to each other through the effect of dynamic friction vectoring. The friction force continues to rise and reaches a maximum when the paddle velocity has reached zero. This force is determined by several variables and can be manipulated to optimize the force and the maximum velocity required for optimum feeding performance. Velocity vectors are illustrated and defined in FIG. 4. As shown in FIG. 4, $V_x$ is the maximum velocity of the paddle 42 during a no-load condition, when the paddle 42 does not encounter the envelope stack 110.

$$V_X=V_R \sin \alpha \cos \alpha \tag{1}$$

Wherein $V_R$ is the velocity of the bottom rod 30. In FIG. 4, $V_W$ is the velocity of the scrub wheel 44. In order to maximize the velocity of the paddle 42 under load, it is necessary to determine the friction force along the X axis, or $F_x$, as shown in FIG. 5. It can be determined that $$F_X=F \cos \alpha \tag{2}$$

$$F_Y=F \sin \alpha \tag{3}$$

$$F=_{\mu d} N \tag{4}$$

where F is the total friction force developed during the operation, $_{\mu d}$ is the dynamic coefficient of friction between the bottom rod 30 and the scrub wheel 44, and N is the total normal force between the bottom rod 30 and the scrub wheel 44. As shown in FIG. 6, the total normal force N is related to the moments about the pivot point 46 as shown below:

$$N=(c/a)mg/+(b/a)\ F_y, \tag{5}$$

where mg is the weight of the paddle assembly 40, and c is the distance from the pivot point 46 to the action line 144 through the center of gravity 142 of the paddle assembly 40, a is the shortest distance between the pivot point 46 and the vector N, and b is the distance between the moment arm 148 and the contact point 146 between the scrub wheel 44 and the bottom rod 30.

By substitute $F_Y$ and F in Equations (2), (3) and (4) in Equation 5, we obtain $$N=(c/a)mg/\{1-(b/a)_{\mu d} \sin \alpha\} \tag{6}$$

and $$F_{X=\mu d}(c/a)mg \cos \alpha/\{1-(b/a)_{\mu d} \sin \alpha\} \tag{7}$$

The optimal condition can be found by differentiating Equation (7) with respect to the variable α. The optimal angle α is related to the dynamic coefficient $_{\mu d}$ and the linear dimensions a, b. It should be noted that when $(b/a)_{\mu d}\sin \alpha=1$, $F_X$ becomes infinitively large. Under such circumstances, a self-locking, jam condition develops.

It should be noted that the optimal velocity depends on the surface of the bottom rod 30, the surface of the scrub wheel 44 and the friction between the scrub wheel 44 and the axis 45 on which it is mounted. The above equations will usually give only a rough estimate of the required rod velocity $V_R$. It has been empirically determined that the optimal velocity of the bottom rods is preferably fifteen (15) inches per second, creating a near frictionless surface. The bottom rods have a corresponding angle α of preferably 10° to 20°, and the tilting angle β of the hopper relative to a horizontal surface has been found to be advantageous at 30°. Of course the given values for the aforesaid angles α and β are only given as preferred angles and may be varied to suit any given application of use. The rotation of the bottom rods 32, 34 will also reduce the friction between the envelope stack 110 and the rods 32, 34, or the friction between the envelope stack 110 and the support surface 112. It is possible to have one or more other scrub wheels, responsive to the rotation of the bottom rods 32 and 34, to provide additional force for pushing the stack advance paddle 42 towards the downstream end of the envelope hopper 10. However, this variation does not depart from the principle of using a rotating rod and a scrub wheel to provide a pushing force to the envelope stack, according to the present invention.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An article hopper for providing a stack of substantially flat articles to an article receiving device positioned adjacent the article hopper, each flat article having at least a bottom elongated edge and a side edge substantially perpendicular to the bottom elongated edge, the article hopper comprising:

a bottom supporting surface having a first end and an opposing second end for supporting a plurality of the of the flat articles between said first and second ends, the bottom supporting surface including at least two, substantially parallel, co-planar and spaced apart first and second rotatable rods extending between the first and second ends wherein the bottom elongated edge of each flat article supported on the bottom supporting surface is disposed against an outer circumference of each rod;

a side supporting rotatable rod extending between the first and second ends of said bottom supporting surface, said side supporting rod is disposed substantially parallel with said first and second rods and resides in a plane spaced apart from the co-planar plane of the first and second rods such that the side edge of each flat article is disposed against an outer circumference of the side supporting rod while the bottom elongated edge of each flat article supported on the bottom supporting surface is disposed against an outer circumference of each rod;

a drive mechanism coupled to the first and second rods of the bottom supporting surface and the side supporting rod for causing the surface of said and second rods to rotate in a first direction at a rate of 15 inches per second and said side supporting rod to rotate in an opposing second direction;

a pushing device pivotally mounted at a pivot positioned above the supporting surface for urging said stack of flat articles disposed on said bottom supporting surface to the first end of the bottom supporting surface;

a feeding mechanism located adjacent the first end of the bottom supporting surface for feeding articles at a periodic interval of 200 milliseconds, the articles received from the first end through pushing action of the pushing device; and a rotation device, having a rotation axis, rotatably mounted on the pushing device and positioned to make contact with first rod of the bottom supporting surface, with the rotation axis oriented at an angle of 10 to 20 degrees relative to the rotation axis of the first rod, wherein the first rod is adapted to rotate along it's rotation axis, causing the rotation device to rotate along it's rotation axis in response to the rotation of the first rod, thereby producing an urging force on the pushing device towards the fist end of the bottom supporting surface;

wherein the bottom supporting surface is tilted at an angle of 30 degrees from horizontal towards the side supporting rod such that said stack of flat articles leans against the side supporting rod.

* * * * *